US008056260B2

(12) United States Patent
Ho

(10) Patent No.: US 8,056,260 B2
(45) Date of Patent: Nov. 15, 2011

(54) GOODYEAR WATERPROOF SHOE

(75) Inventor: Shu Tzu Ho, San Chung (TW)

(73) Assignee: Golden Chang Industrial Co., Ltd., Taipei (TW)

( * ) Notice: Subject to any disclaimer, the term of this patent is extended or adjusted under 35 U.S.C. 154(b) by 520 days.

(21) Appl. No.: 12/352,788

(22) Filed: Jan. 13, 2009

(65) Prior Publication Data

US 2010/0175274 A1 Jul. 15, 2010

(51) Int. Cl.
*A43B 13/00* (2006.01)

(52) U.S. Cl. ..... 36/17 R; 36/17 PW; 12/142 D; 12/142 T

(58) Field of Classification Search ..... 36/14, 17 R, 36/17 A, 17 PW, 21; 12/142 D, 142 C, 142 RS, 12/142 T
See application file for complete search history.

(56) References Cited

U.S. PATENT DOCUMENTS 2,275,574 A * 3/1942 Vizard ..... 36/17 R
3,736,613 A * 6/1973 Tusa et al. ..... 12/142 D
5,743,027 A * 4/1998 Barma ..... 36/4
6,601,319 B1 * 8/2003 Clements ..... 36/17 R
6,637,131 B2 10/2003 Lee
7,644,519 B2 * 1/2010 Su ..... 36/30 R
7,836,609 B2 * 11/2010 Covatch ..... 36/17 R
2005/0091883 A1 * 5/2005 Davis ..... 36/76 R

FOREIGN PATENT DOCUMENTS

TW 325648 1/1998

* cited by examiner

*Primary Examiner* — Marie Patterson
(74) *Attorney, Agent, or Firm* — Muncy, Geissler, Olds & Lowe, PLLC

(57) ABSTRACT

A Goodyear waterproof shoe includes a main body stitched with a shoe collar and having a bottom portion coupled sequentially with a filler plate, a thin sole, and an outsole. An outer welt is stitched to a lower outer rim of the main body by a thread and stitched to the thin sole by another thread. The Goodyear waterproof shoe is characterized in that the main body is an integrally formed waterproof body having an upper opening and includes a shoe-shaped portion, the bottom portion, and a welt portion on a lower side of the bottom portion. The thread for stitching the outer welt to the main body passes through the welt portion but not the bottom portion of the main body so as to enhance waterproofness. The main body is integrally formed from the upper, midsole, and inner welt of a conventional Goodyear shoe to reduce production procedures and assembly time.

5 Claims, 3 Drawing Sheets

GOODYEAR WATERPROOF SHOE

BACKGROUND OF THE INVENTION

1. Technical Field

The present invention relates to waterproof shoes and, more particularly, to a waterproof shoe made by the Goodyear process and having excellent waterproofness.

2. Description of Related Art

Work shoes made and stitched by the Goodyear process are called Goodyear shoes. These shoes, strong and durable, are suitable for use in factories as well as for hunting, firefighting, military actions, and so on, where strict safety protection is required. Goodyear shoes often feature superior waterproofness.

A conventional Goodyear shoe is made waterproof by immersing an upper of the shoe in grease or wax and applying a waterproof glue to a stitch seam of the shoe. Other patented waterproofing techniques for Goodyear shoes include, for example, Taiwan Patent Publication No. 325648, in which a formed pad (midsole) is bonded to a waterproof thin sole; and U.S. Pat. No. 6,637,131, in which an inner welt, an upper, and an outer welt are sewn together with a thread, and when an outer sole (outsole) is formed and fixedly provided at bottoms of the welts, a liquid plastic material yet to be formed penetrates into and fills up clearances around the welts so as to block water from entering the shoe through the clearances.

No matter which of the above waterproofing techniques for the Goodyear shoe is used, the stitching thread extends well into the shoe. Although waterproofness is achieved by applying the waterproof glue or by filling the clearances with molten plastic when forming the outsole, the waterproof effect is good only for a while. After the shoe is used for some time, gaps are bound to develop between the glue and the thread so that waterproofness is compromised. Furthermore, all the aforesaid waterproofing techniques are fragmentary waterproof treatments. For example, the above-referenced Taiwan Patent Publication No. 325648 only uses a waterproof thin sole whereas the midsole located at an inner surface of the shoe is made of paper and not water-resistant. Similarly, in the above-cited U.S. Pat. No. 6,637,131, as shown in FIG. 1, an upper 91, though made of a waterproof material, has an open bottom where a paper-made midsole 92 is passed through by a thread 93. In consequence, water infiltration is still likely to occur if the waterproof treatment is incomplete or after the shoe is used for a period of time. Moreover, in order to make a robust Goodyear shoe, an inner welt 94 and an outer welt 95 are provided on an inner side and an outer side of the bottom of the upper 91, respectively, and stitched in place by a thread so as to reinforce the upper 91 sandwiched between the welts. However, stitch seams thus formed must also be waterproofed. Thus, the entire manufacturing process of the Goodyear shoe is complicated and time-consuming and leads to a high production cost.

BRIEF SUMMARY OF THE INVENTION

In view of the aforesaid shortcomings of the existing waterproofing techniques for the conventional Goodyear shoe, the present invention provides a Goodyear waterproof shoe which overcomes the drawbacks of the conventional Goodyear shoe such as having the stitching thread extend deep into the shoe and exhibiting defective waterproofness due to the fragmentary waterproofing techniques.

In addition, the Goodyear waterproof shoe according to the present invention features a simple structure and thus a simple manufacturing process, thereby improving the disadvantageously complicated manufacturing process of the conventional Goodyear shoe.

In order to solve the problems of the conventional Goodyear shoe, the present invention provides a Goodyear waterproof shoe comprising a main body. The main body is stitched with a shoe collar from above and has a bottom portion coupled sequentially with a filler plate, a thin sole, and an outsole. An outer welt is stitched to a lower outer rim of the main body by a first thread so as to cover the lower outer rim. The outer welt is stitched to the thin sole by a second thread. The Goodyear waterproof shoe is characterized in that the main body is integrally formed of a waterproof material and comprises, from top to bottom, a shoe-shaped portion, the bottom portion, and a welt portion, wherein the shoe-shaped portion and the bottom portion jointly form a shoe shape, and the shoe-shaped portion has an upper end provided with an upper opening to which the shoe collar is stitched; and the welt portion is provided on a lower side of the bottom portion so as to form a concave space below the bottom portion for receiving the filler plate, wherein the welt portion is stitched to the outer welt by the first thread.

According to the manufacturing process of the conventional Goodyear shoe, the upper, the midsole, and the inner welt must be manufactured separately and then assembled together. However, in the Goodyear waterproof shoe 1 according to the present invention, the aforesaid three components, namely the upper, the midsole, and the inner welt, are injection molded as one piece to form the main body of the Goodyear waterproof shoe, thereby reducing the production procedures and time otherwise required for making plural components.

Compared with the conventional Goodyear shoe, the Goodyear waterproof shoe disclosed herein involves the following inventive steps:

The main body is integrally formed from the upper, the midsole, and the inner welt taught in the prior art, so as to reduce the production procedures otherwise required for making plural components;

The main body comprises the welt portion, which facilitates stitching of the outer welt and increases yield. In addition, the thread for stitching the outer welt to the main body passes through only the welt portion, but not the bottom portion, of the main body, thereby significantly enhancing waterproofness of the Goodyear waterproof shoe according to the present invention.

According to the Goodyear waterproof shoe disclosed herein, the main body has a lower surface bonded to the thin sole and formed with a reinforcing portion. The reinforcing portion is made of the same material as the main body and integrally formed therewith. Alternatively, the reinforcing portion is made of a material different from that of the main body and is completely enclosed by the main body. For example, the reinforcing portion is implemented as a reinforcing metal plate of the conventional Goodyear shoe and completely enclosed by the main body. Thus, not only is the procedure for riveting the metal plate to a lower portion of the midsole dispensed with, but also the defects in waterproofness resulting from such procedure are prevented.

BRIEF DESCRIPTION OF THE SEVERAL VIEWS OF THE DRAWINGS

The invention as well as a preferred mode of use, further objectives and advantages thereof will be best understood by referring to the following detailed description of an illustrative embodiment in conjunction with the accompanying drawings, wherein.

DETAILED DESCRIPTION OF THE INVENTION

At least one embodiment of the present invention is provided herein for demonstrating a preferred mode of implementation and features of the present invention.

Figure 1:
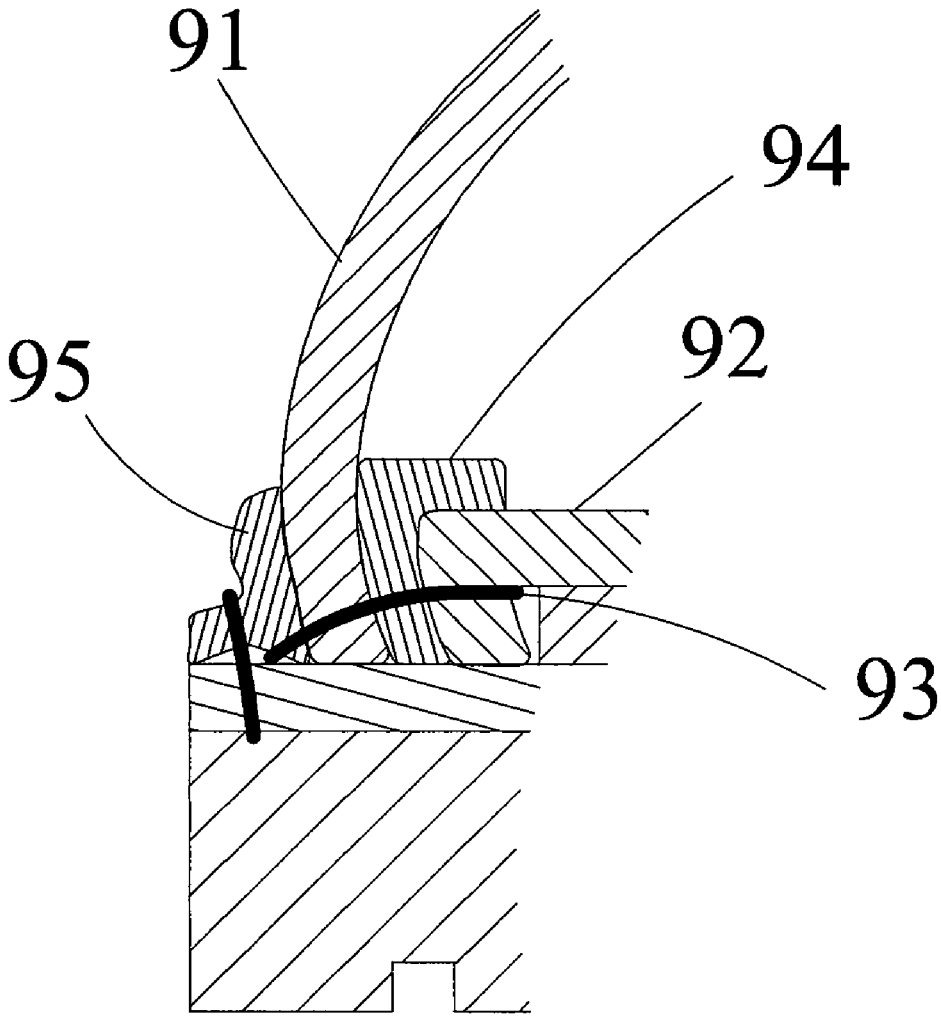
FIG.1 PRIOR ART
FIG. 1 is a partial sectional view of a conventional Goodyear shoe.
Figure 2:
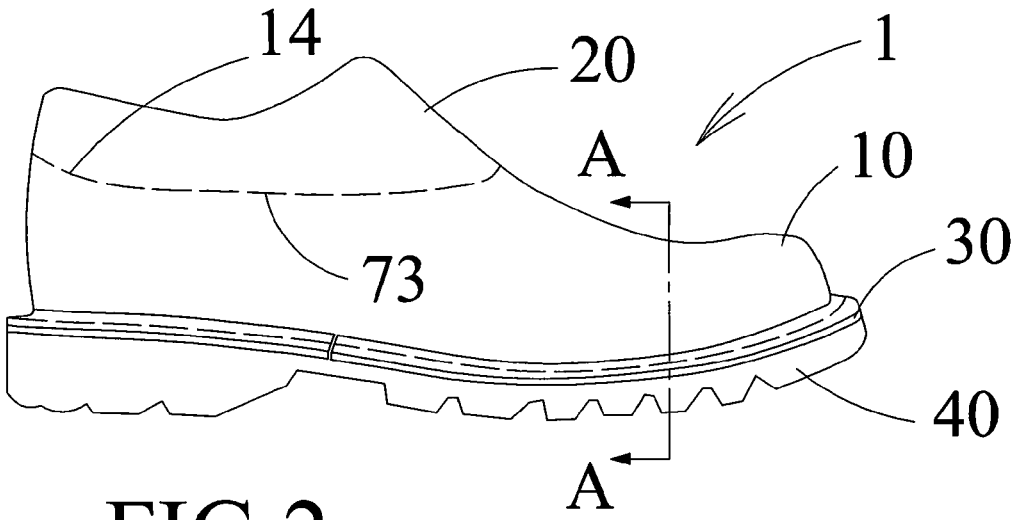
FIG. 2 is a front view of a Goodyear waterproof shoe according to the present invention.
Figure 3:
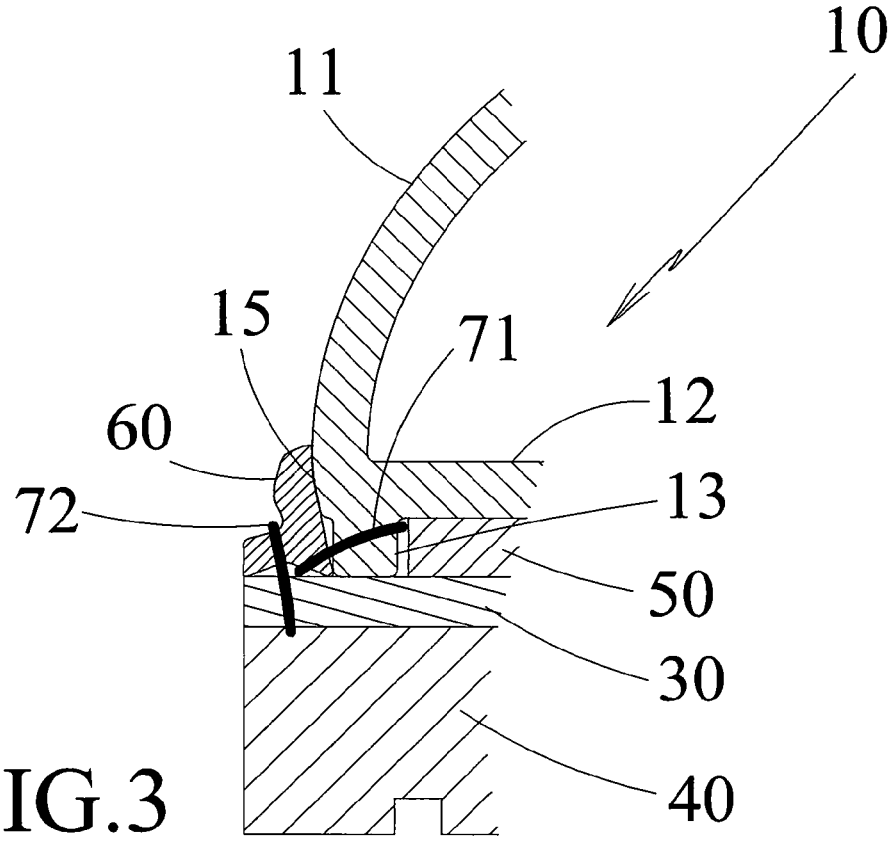
FIG. 3 is a partial sectional view of the Goodyear waterproof shoe according to the present invention taken along line A-A of FIG. 2.

Referring to FIGS. 2 and 3, a Goodyear waterproof shoe 1 according to a preferred embodiment of the present invention comprises a waterproof main body 10. The main body 10 is stitched with a shoe collar 20 from above and comprises a bottom portion 12 coupled with a thin sole 30 and an outsole 40. The main body 10 is a partially closed enclosure provided with only one upper opening 14 and integrally formed of a waterproof material such as rubber, thermoplastic polyurethane (TPU), and so on. The main body 10 comprises a shoe-shaped portion 11, the bottom portion 12, and a welt portion 13, wherein the shoe-shaped portion 11 and the bottom portion 12 jointly form a basic shape of the Goodyear waterproof shoe 1, and the upper opening 14 of the main body 10 is provided at an upper end of the shoe-shaped portion 11. In addition, the welt portion 13 is provided on a lower side of the bottom portion 12 so as to form a concave space below the bottom portion 12 for receiving a filler plate 50 configured to support the bottom portion 12. The main body 10 has a lower outer rim 15 covered by an outer welt 60, and the outer welt 60 is stitched to the welt portion 13 of the main body 10 by a thread 71. Furthermore, as in the prior art, the outer welt 60 is stitched to the thin sole 30 by a thread 72 before the thin sole 30 is bonded to the outsole 40.

In the manufacturing process of the conventional Goodyear shoe, the upper, the midsole, and the inner welt must be separately made and then assembled together. In contrast, the main body 10 of the Goodyear waterproof shoe 1 according to the present invention is injection molded so as to combine the aforesaid three components, thus reducing the production procedures and time otherwise required for making plural components.

According to the manufacturing process of the conventional Goodyear shoe, it is necessary to clamp the formed upper and the midsole together and then couple them fixedly to each other with a steel wire passing through lower edges thereof. However, in the Goodyear waterproof shoe 1 according to the present invention, the integrally formed main body 10 is injection molded so as to combine the upper, the midsole, and the inner welt which are otherwise separately made in the prior art. Therefore, the clamping and wiring procedures in the manufacturing process of the conventional Goodyear shoe are eliminated in the present invention.

When manufacturing the conventional Goodyear shoe, it is required that, after the upper is coupled to the midsole, the inner welt and the outer welt be provided on the inner side and the outer side of the upper, respectively, and stitched to the upper as a whole. During this process, the inner welt and the outer welt must be aligned with each other for stitching, which adds to the difficulty of the manufacturing process. However, in the Goodyear waterproof shoe 1 according to the present invention, the main body 10 is already formed with the welt portion 13. Therefore, all one has to do is directly align the outer welt 60 with the welt portion 13 of the main body 10 and stitch them together. In consequence, the manufacturing process is significantly simplified, and the production time is shortened.

Moreover, the upper of the conventional Goodyear shoe is provided with the open bottom. Although the bottom is waterproofed after being stitched with the midsole and the welts, the thread will get loose and the glue will age after the shoe is used for a period of time. As a result, water may infiltrate the shoe through the bottom of the upper. In contrast, the main body 10 of the Goodyear waterproof shoe 1 according to the present invention has only one said upper opening 14. Moreover, the thread 71 for stitching the outer welt 60 to the main body 10 passes through only the welt portion 13 underneath the main body 10 but not the bottom portion 12 of the main body 10. Therefore, as long as the Goodyear waterproof shoe 1 is not wading through a body of water whose water level is higher than the location of a thread 73 for stitching the shoe collar 20 to the main body 10, water is unlikely to enter the shoe through the bottom portion 12 of the main body 10 so that waterproofness is assured. Even if the water level is higher than the location of the thread 73, the Goodyear waterproof shoe 1 according to the present invention is still equipped with waterproof measures provided inside and outside the conventional Goodyear shoe to provide sufficient waterproofness, unless the Goodyear waterproof shoe 1 is entirely immersed in water.

Figure 4:
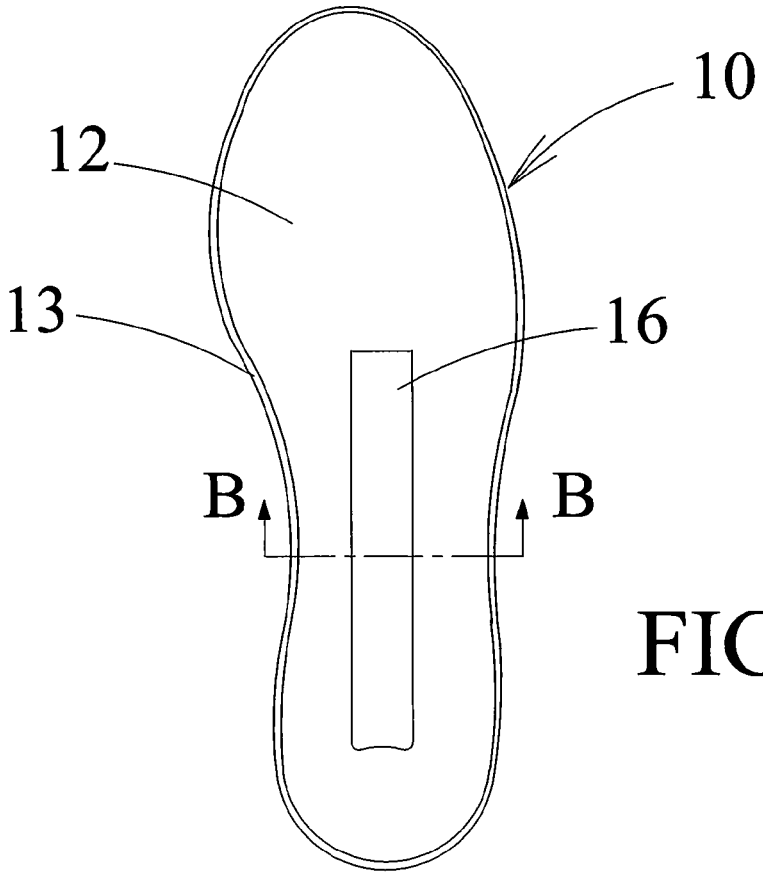
FIG. 4 shows a lower surface of a main body of the Goodyear waterproof shoe according to the present invention, wherein the lower surface is provided with a reinforcing portion.
Figure 5:
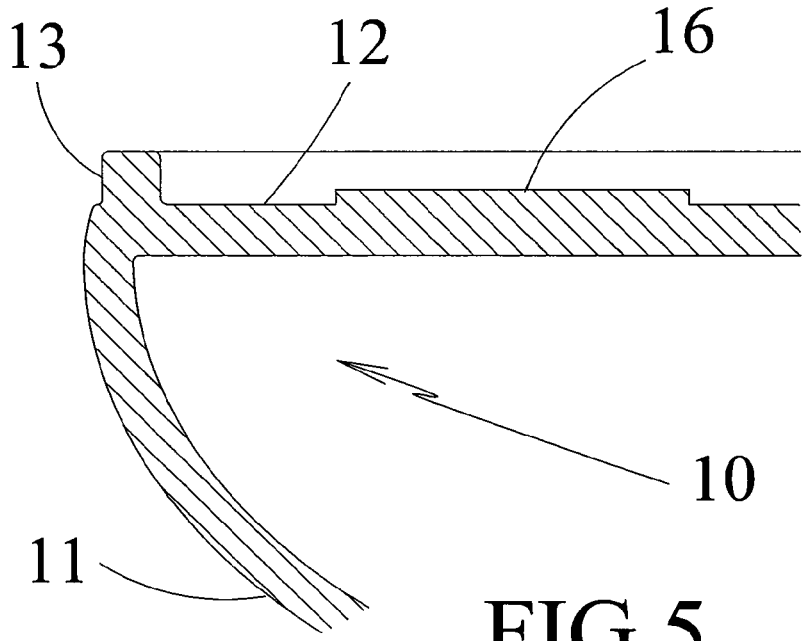
FIG. 5 is a partial sectional view taken along line B-B of FIG. 4.

According to the structure of the conventional Goodyear shoe, the midsole has a surface bonded to a filler plate and coupled with a metal plate for reinforcing the Goodyear shoe as a work shoe. However, in the Goodyear waterproof shoe 1 according to the present invention, as shown in FIGS. 4 and 5, the main body 10 has a lower surface bonded to the thin sole 30 and formed with a reinforcing portion 16. The reinforcing portion 16, which is the metal plate in the prior art or is made of another material, is placed in an injection mold for the main body 10 in advance and when the main body 10 is being injection molded, is completely enclosed by the main body 10. Alternatively, the reinforcing portion 16 is made of the same material, such as rubber or TPU, as the main body 10 and formed as an integral part thereof. In the present preferred embodiment, for example, the reinforcing portion 16 is made of TPU and integrally formed with the main body 10.

The embodiment described above is provided to demonstrate the preferred mode of implementation of the present invention but not intended to limit the scope of rights of the present invention. It is possible for a person of ordinary skill in the art to make modifications and changes to the disclosed embodiment after reviewing the technical contents disclosed herein without departing from the spirit of the present invention. Therefore, the scope of rights of the present invention is defined only by the appended claims.

The invention claimed is:

1. A Goodyear waterproof shoe, comprising a main body, the main body being stitched with a shoe collar from above and having a bottom portion coupled sequentially with a filler plate, a thin sole, and an outsole, an outer welt being stitched to a lower outer rim of the main body by a first thread so as to cover the lower outer rim, the outer welt being stitched to the thin sole by a second thread, the Goodyear waterproof shoe being characterized in that:

the main body is integrally formed of a waterproof material and comprises, from top to bottom, a shoe-shaped portion, a bottom portion, and a welt portion, wherein the shoe-shaped portion and the bottom portion jointly form a shoe shape, and the shoe-shaped portion has an upper end provided with an upper opening, the shoe collar being stitched to the upper opening; and the welt portion is provided on a lower side of the bottom portion so as to form a concave space below the bottom portion for receiving the filler plate, the welt portion being stitched to the outer welt by the first thread.

2. The Goodyear waterproof shoe of claim 1, wherein the main body has a lower surface bonded to the thin sole and formed with a reinforcing portion.

3. The Goodyear waterproof shoe of claim 2, wherein the reinforcing portion is made of a same material as the main body and integrally formed therewith.

4. The Goodyear waterproof shoe of claim 2, wherein the reinforcing portion is made of a material different from a material of the main body and is completely enclosed by the main body.

5. The Goodyear waterproof shoe of claim 4, wherein the reinforcing portion is a metal plate completely enclosed by the main body.

* * * * *